US009011764B2

(12) United States Patent
Kloewer et al.

(10) Patent No.: US 9,011,764 B2
(45) Date of Patent: Apr. 21, 2015

(54) NICKEL-CHROMIUM-COBALT-MOLYBDENUM ALLOY

(75) Inventors: Jutta Kloewer, Duesseldorf (DE); Juergen Tewes, Iserlohn (DE); Ralf-Udo Husemann, Ratingen (DE)

(73) Assignee: VDM Metals GmbH, Werdohl (DE)

( * ) Notice: Subject to any disclaimer, the term of this patent is extended or adjusted under 35 U.S.C. 154(b) by 135 days.

(21) Appl. No.: 13/634,962

(22) PCT Filed: Mar. 15, 2011

(86) PCT No.: PCT/DE2011/000259

§ 371 (c)(1), (2), (4) Date: Sep. 14, 2012

(87) PCT Pub. No.: WO2011/113419

PCT Pub. Date: Sep. 22, 2011

(65) Prior Publication Data

US 2013/0011295 A1 Jan. 10, 2013

(30) Foreign Application Priority Data

Mar. 16, 2010 (DE) ..... 10 2010 011 609
Mar. 4, 2011 (DE) ..... 10 2011 013 091

(51) Int. Cl.

| | |
|---|---|
| ***C22C 19/05*** | (2006.01) |
| ***C22F 1/10*** | (2006.01) |
| ***C21D 1/30*** | (2006.01) |
| ***C21D 6/00*** | (2006.01) |
| ***C22C 1/02*** | (2006.01) |

(52) U.S. Cl.

CPC ... *C22F 1/10* (2013.01); *C21D 1/30* (2013.01); *C21D 6/002* (2013.01); *C21D 2211/004* (2013.01); *C22C 1/02* (2013.01); *C22C 1/023* (2013.01); *C22C 19/05* (2013.01); *C22C 19/055* (2013.01)

(58) Field of Classification Search

None

See application file for complete search history.

(56) References Cited

U.S. PATENT DOCUMENTS

| | | | |
|---|---|---|---|
| 2004/0101433 | A1 | 5/2004 | Brill et al. |
| 2009/0074584 | A1 | 3/2009 | Nemoto et al. |

FOREIGN PATENT DOCUMENTS

| | | | |
|---|---|---|---|
| CN | 1412331 | A | 4/2003 |
| CN | 101386939 | A | 3/2009 |
| EP | 0 358 211 | | 3/1990 |
| EP | 1 270 754 | A1 | 1/2003 |
| EP | 2 039 789 | | 3/2009 |
| EP | 2 204 462 | | 7/2010 |
| JP | 8-3666 | A | 1/1996 |
| JP | 11-170084 | A | 6/1999 |
| JP | 2002-212634 | A | 7/2002 |

OTHER PUBLICATIONS

J. Chapovaloff et al, Parameters governing the reduction of oxide layers on Inconel 617 in impure VHTR He atmosphere, Materials and Corrosion, 2008 Wiley-VCH, vol. 59, Issue No. 7, pp. 584-590.

International Search Report of PCT/DE2011/000259, Jul. 22, 2011.

Chapovaloff J. et al: "Parameters governing the reduction of oxide layers on Inconel 617 in impure VHTR He atmosphere." Materials and Corrosion—Werkstoffe and Korrosion, vol. 59, No. 7, Jul. 1, 2008, pp. 584-590, XP-001515130, Wiley-VCH, Weinheim, Germany, ISSN: 0947-5117, DOI: 10.1002/maco.200804141. (ISR) (Spec, p. 2—See Preliminary Amendment).

"Nicrofer® 5520 Co—alloy 617—Material Data Sheet No. 4019", ThyssenKrupp VDM, Jan. 1, 2005, pp. 1-12, XP-002644223, retrieved from the Internet: URL:http://www.thyssenkrupp.ch/documents/2663_e.pdf [retrieved on Jun. 21, 2011]. (ISR) (Spec, p. 2—See Preliminary Amendment).

*Primary Examiner* — Deborah Yee

(74) *Attorney, Agent, or Firm* — Collard & Roe, P.C.

(57) ABSTRACT

A nickel-chromium-cobalt-molybdenum alloy includes (in weight %) Cr 21-23%, Fe 0.05-1.5%, C 0.05-0.08%, Mn≤0.5%, Si≤0.25%, Co 11-13%, Cu≤0.15%, Mo 8.0-10.0%, Ti 0.3-0.5%, Al 0.8-1.3%, P<0.012%, S<0.008%, B>0.002-<0.006%, Nb>0-1%, N≤0.015%, Mg≤0.025%, Ca≤0.01%, V 0.005-0.6%, optionally W in contents between 0.02-max. 2%, Ni rest as well as smelting-related impurities, in the form of tubes, sheets, wire, bars, strips or forgings, wherein the alloy satisfies the following formula: X3=5–50, wherein $$X3 = 100 * \frac{X1}{X2}$$

and X1=C+5N and X2=0.5Ti+Nb+0.5 V.

4 Claims, No Drawings

NICKEL-CHROMIUM-COBALT-MOLYBDENUM ALLOY

CROSS REFERENCE TO RELATED APPLICATION

This application is the National Stage of PCT/DE2001/000259 filed on Mar. 15, 2011, which claims priority under 35 U.S.C. §119 of German Application No. 10 2010 011 609.2 filed on Mar. 16, 2010 and under 35 U.S.C. §119 of German Application No. 10 2011 013 091.8 filed on Mar. 4, 2011, the disclosures of which are incorporated by reference. The international application under PCT article 21(2) was not published in English.

The invention relates to a nickel-chromium-cobalt-molybdenum alloy with excellent strengths and creep characteristics as well as extraordinary resistance to high-temperature corrosion.

EP 2039789 A1 discloses a nickel-base alloy for a turbine motor for a steam engine, containing: C 0.01 to 0.15%, Cr 18 to 28%, Co 10 to 15%, Mo 8 to 12%, Al 1.5 to 2%, Ti 0.1 to 0.6%, B 0.001 to 0.006%, Ta 0.01 to 0.7%, rest nickel and unavoidable impurities. This composition is supposed to have an elevated mechanical strength with simultaneous retention of forging characteristics.

A nickel-chromium-molybdenum-cobalt alloy with a special carbide morphology that imparts a better creep rupture strength at elevated temperatures to the alloy has become known through EP 0358211 B1 or EP 2204462 A1. The alloy consists (in % by wt) of 15 to 30% chromium, 6 to 12% molybdenum, 5 to 20% cobalt, 0.5 to 3% aluminum, up to 5% titanium, 0.04 to 0.15% carbon, up to 0.02% boron, up to 0.5% zirconium, up to 5% tungsten, up to 2.5% niobium or tantalum, up to 5% iron, up to 0.2% rare earth metals, up to 0.1% nitrogen, up to 1% copper, up to 0.015% sulfur, up to 0.03% phosphorus and up to 0.2% magnesium or calcium, rest nickel except for impurities.

Even though the alloys may contain up to 2.5% Nb or Ta, these elements impair the resistance to cyclic oxidation, which occurs particularly strongly with simultaneous presence of chromium and aluminum.

A paper entitled Parameters governing the reduction of oxide layers on Inconel 617 in impure VHTR HE atmosphere (Chapovaloff J. et al.) can be found on pages 584 to 590 of the periodical Materials and Corrosion 2008, 59 No. 7). In Table 1 of this paper, the material Inconel 617 is characterized by the following composition: Cr 21.56%, Co 12%, Mo 9.21%; Fe 0.95%, Mn 0.10%, Ti 0.41%, Al 1.01%, C 0.06%, Cu 0.07%, Si 0.15%, B 0.002%, rest nickel.

From the "Nicrofer 5520 Co Alloy 617" data sheet of ThyssenKrupp VDM GmbH of January 2005, the cited material that has the following composition can be found on pages 1 to 12

Cr 20-24%
Fe max. 3%
C 0.05 to 0.15%
Mn max. 1%
Si max. 1%
Co 10 to 15%
Cu max. 0.5%
Mo 8 to 10%
Ti max. 0.6%
Al 0.8 to 1.5%
P max. 0.012%
S max 0.015%
B max. 0.006%
Ni Rest Such alloys have been used in practice for many decades and are known under the designation "alloy 617". It has been found that structural parts made from such alloys have a certain tendency to stress cracks in the temperature range from 550 to 850° C. This has been evident in particular at welded joints of thick-walled components. Internal stresses in conjunction with carbide precipitates are regarded as causes for this. To some extent it has been possible to eliminate this by a multi-hour heat treatment at ca. 1,000° C., but in some cases it has been possible to perform such a heat treatment not at all or only with great difficulties.

It is the task of the invention to so improve this known and also proven alloy by purposeful modification of individual alloying elements that the indicated disadvantages are no longer present.

This task is accomplished by a nickel-chromium-cobalt-molybdenum alloy consisting of (in % by wt)

Cr 21-23%
Fe 0.05-1.5%
C 0.03-0.08%
Mn≤0.5%
Si≤0.25%
Co 11-13%
Cu≤0.15%
Mo 8.0-10.0%
Ti 0.3-0.5%
Al 0.8-1.3%
P<0.012%
S<0.008%
B>0.002-<0.008%
Nb>0-1%
N≤0.015%
Mg≤0.05%
Ca≤0.01%
V 0.005-0.6%,
optionally W in contents between 0.02-max. 2%
Ni Rest as well as smelting-related impurities, in the form of tubes, sheets, wire, bars, strips or forgings, wherein the alloy satisfies the following formula:

$$X3=5-50, \text{ wherein}$$

$$X3 = 100 * \frac{X1}{X2}$$

and $$X1=C+5N$$

and $$X2=0.5Ti+Nb+0.5V.$$

A preferred alloy composition is represented as follows (in % by wt):

Cr 21-23%
Fe 0.05-1.5%
C 0.03-0.08%
Mn≤0.5%
Si≤0.25%
Co 11-13%
Cu≤0.15%
Mo 8.0-10.0%
Ti 0.3-0.5%

Al 0.8-1.3%

P<0.012%

S<0.008%

B>0.002-<0.008%

Nb>0-1%

N≤0.015%

Mg≤0.05%

Ca≤0.01%

V 0.005-≤0.6%

Ni Rest as well as smelting-related impurities.

It is of particular advantage when the content of B is adjusted as follows:

B 0.002-0.005%

The Mn content is advantageously ≤0.3%. If necessary, the alloy may contain W as a further element in contents between 0.02 and 2%.

It is of further advantage when the vanadium content in the alloy according to the invention is adjusted between 0.005 and ≤0.6%.

Surprisingly, it has been found that the precipitation of chromium carbide stringers can be suppressed by purposeful alloying with Nb and/or V as well as B. Thereby the tendency toward formation of stress cracks during welding is considerably reduced during operation.

According to a further idea of the invention, the alloy according to the invention satisfies the following formula:

X3=5−50, wherein $$X3 = 100 * \frac{X1}{X2}$$

and

X1=C+5N and

X2=0.5Ti+Nb+0.5V.

If necessary for the increase of the ductility and for the elimination of stresses, the alloy according to the invention may be subjected to a heat treatment in the temperature range between 800 and 1,000° C., preferably at 980° C. In this way the proportion of carbides should advantageously be >0.9%. By purposeful adjustment especially of the contents of Nb, V and B, such a heat treatment may now be performed without difficulties.

By virtue of the subject matter of the invention, a highly creep-resistant alloy for operating temperatures between 500 and 1,200° C. is obtained.

The alloy according to the invention is usable not only in the form of tubes, sheets, wire, bars, forgings or castings and strips, but also for welded constructions. Preferred areas of application are gas turbines, the construction of furnaces and power plants, the petrochemical industry and the field of nuclear power engineering.

In Table 1, an alloy that may be regarded as belonging to the prior art is compared with 5 variants V1 to V5 according to the invention.

TABLE 1

| Element | VdTÜV Material Sheet 485 % by wt | Prior art Typical analysis % by wt | V1 Nb 0.5 % by wt | V2 Nb 0.5 V 0.2 % by wt | V3 V 0.2 % by wt | V4 V 0.65 % by wt | V5 Mo high % by wt |
|---|---|---|---|---|---|---|---|
| Ni | Rest | Rest | Rest | Rest | Rest | Rest | Rest |
| Cr | 20.0-23.0 | 22.08 | 22 | 22 | 22 | 21.9 | 21.5 |
| Co | 10.0-13.0 | 11.54 | 12.2 | 12.2 | 12.4 | 12.4 | 12.4 |
| Mo | 8.0-10.0 | 8.65 | 8.4 | 8.4 | 8.4 | 8.4 | 9.5 |
| Ti | 0.20-0.50 | 0.39 | 0.41 | 0.4 | 0.4 | 0.4 | 0.41 |
| Al | 0.60-1.50 | 1.09 | 0.86 | 0.84 | 0.84 | 0.82 | 0.88 |
| Fe | max. 2.0 | 1.22 | 0.32 | 0.36 | 0.1 | 0.23 | 0.03 |
| Mn | max. 0.70 | 0.1 | 0.02 | 0.02 | 0.02 | 0.02 | 0.02 |
| Si | max. 0.70 | 0.2 | <0.01 | <0.01 | <0.01 | <0.01 | 0.01 |
| C | 0.050-0.100 | 0.062 | 0.05 | 0.05 | 0.05 | 0.05 | 0.065 |
| P | max. 0.012 | 0.003 | <0.001 | <0.01 | 0.002 | 0.002 | 0.002 |
| S | max. 0.008 | <0.002 | <0.001 | <0.001 | <0.001 | <0.001 | <0.001 |
| As | max. 0.010 | 0.001 | <0.01 | <0.01 | <0.01 | <0.01 | <0.01 |
| B | max. 0.001 | 0.001 | 0.0033 | 0.0034 | 0.0034 | 0.0033 | 0.0028 |
| Pb | max. 0.007 | 0.0002 | <0.005 | <0.005 | <0.005 | <0.005 | <0.005 |
| V | | 0.02 | <0.01 | 0.18 | 0.18 | 0.6 | <0.01 |
| N | | 0.011 | <0.01 | <0.01 | <0.01 | <0.01 | <0.01 |
| Nb | | 0.02 | 0.55 | 0.5 | <0.01 | <0.01 | <0.01 |
| W | | 0.4 | 0.1 | 0.1 | 0.1 | 0.1 | 0.1 |

In Table 2, alloys that may be regarded as belonging to the prior art and five variants V1 to V5 according to the invention are compared with regard to the dissolution behavior of the carbides.

TABLE 2

| Variant | Nb % by wt | V % by wt | Mo % by wt | Solution annealing temp. M6C primary carbide ° C. | Solvus Cr carbide ° C. |
|---|---|---|---|---|---|
| Prior art | 0 | 0 | 8-10 | 1250-1290 | 990-1000 |
| V1 | 0.55 | <0.01 | 8.4 | 1237 | 1096 |
| V2 | 0.5 | 0.18 | 8.4 | 1207 | 1153 |
| V3 | <0.01 | 0.18 | 8.4 | 1228 | 1133 |
| V4 | <0.01 | 0.6 | 8.4 | 1214 | 1182 |
| V5 | <0.01 | <0.01 | 9.5 | 1290 | 839 |

In Table 3, an alloy that may be regarded as belonging to the prior art and 5 variants V1 to V5 according to the invention are compared with regard to the ductility (SSRI test at 700° C.)

TABLE 3

| Variant | Comment | Reduction of area (Z) ° C. | Elongation (A) ° C. |
|---|---|---|---|
| Prior art | Without boron | 7.5 | 5 |
| V1 | | 14 | 8.5 |
| V2 | | 11 | 8.5 |
| V3 | | 21 | 24 |
| V4 | | 42 | 21 |
| V5 | | 20 | 10 |

The invention claimed is:

1. Nickel-chromium-cobalt-molybdenum alloy, consisting of (in % by wt)

Cr 21-23%
Fe 0.05-1.5%
C 0.05-0.08%
Mn≤0.5%
Si≤0.25%
Co 11-13%
Cu≤0.15%
Mo 8.0-10.0%
Ti 0.3-0.5%
Al 0.8-1.3%
P<0.012%
S<0.008%
B>0.002-<0.006%
Nb>0-1%
N≤0.015%
Mg≤0.025%
Ca≤0.01%
V≤0.005-≤0.6%,
optionally W in contents between 0.02-max. 2%
Ni Rest as well as smelting-related impurities,
in the form of tubes, sheets, wire, bars, strips or forgings, wherein the alloy satisfies the following formula:

X3=5−50, wherein $$X3 = 100 * \frac{X1}{X2}$$

and

X1=C+5N and

X2=0.5Ti +Nb+0.5V.

2. Alloy according to claim 1, with (in % by wt): B>0.002-<0.005%.

3. Alloy according to claim 1, with (in % by wt) Mn≤0.3%.

4. Alloy according to claim 1, wherein the proportion of carbides is >0.9%.

* * * * *